US005980277A

United States Patent [19]

Ichimura

[11] Patent Number: 5,980,277

[45] Date of Patent: Nov. 9, 1999

[54] ZIF CONNECTOR CAPABLE OF OPERATING WITH SMALL OPERATION FORCE

[75] Inventor: Yoshiaki Ichimura, Akiruno, Japan

[73] Assignee: Japan Aviation Electronics Industry, Limited, Tokyo, Japan

[21] Appl. No.: 08/911,941

[22] Filed: Aug. 20, 1997

[51] Int. Cl.[6] ..... H01R 13/44

[52] U.S. Cl. ..... 439/141; 439/67; 439/260

[58] Field of Search ..... 439/67, 260, 495, 439/259, 493, 140, 141

[56] References Cited

U.S. PATENT DOCUMENTS

| | | | |
|---|---|---|---|
| 5,052,936 | 10/1991 | Biechler et al. | 439/260 |
| 5,597,317 | 1/1997 | Hansell, III et al. | 437/140 |
| 5,622,505 | 4/1997 | Hashiguchi et al. | 439/260 |

*Primary Examiner*—Hien Vu

*Attorney, Agent, or Firm*—J. Warren Whitesel; Laff, Whitesel & Saret, Ltd.

[57] ABSTRACT

A ZIF connector includes a flexible contact, a fixed housing receiving therein the contact, and a movable housing slidably received in the fixed housing for receiving a contact portion of a counterpart connector. The contact portion of the counterpart connector includes a bifurcate portion into which a contact portion of the contact is fittable. The contact portion of the contact extends along an attaching/detaching direction of the counterpart connector in the fixed housing, while the contact has a bent portion near a bottom wall of the fixed housing. The movable housing supports the contact portion of the contact along the foregoing attaching/detaching direction, while allowing deformation of the contact portion of the contact. Due to approaching of the counterpart connector for connection, the contact portion of the contact advances into the contact portion of the counterpart connector so that the contact is then pushed by the counterpart connector to move the bent portion thereof along the bottom wall of the fixed housing in a direction orthogonal to the foregoing attaching/detaching direction. Thus, the contact portion of the contact is deformed to abut under pressure against the contact portion of the counterpart connector at two positions.

8 Claims, 9 Drawing Sheets

ZIF CONNECTOR CAPABLE OF OPERATING WITH SMALL OPERATION FORCE

BACKGROUND OF THE INVENTION

The present invention relates to a ZIF (zero insertion force) connector and, in particular, to a ZIF connector which is capable of operating with a small operation force even in case of a multiconductor connector.

Various types of ZIF connectors have been proposed for reducing operation forces required upon attachment and detachment of the connectors even in case of multiconductor connectors. However, in the conventional ZIF connector of any type, a resistance force required for deformation of contacts upon connection to contacts of a counterpart connector is not sufficiently small. Hence, the conventional ZIF connector is poor in operating property and complicate in structure. Further, in the conventional ZIF connector, the number of parts is large, the assembling processes are complicate and thus the production cost is high.

In the conventional ZIF connector, contacts are provided as separate members, so that reduction in diameter of each contact has its own limit. For this reason, in the conventional ZIF connector, there has been the limit in view of the density of the contacts.

SUMMARY OF THE INVENTION

Therefore, it is an object of the present invention to provide an improved ZIF connector, wherein a resistance force required for deformation of a contact upon connection to a contact portion of a counterpart connector is small to reduce a required operation force.

It is another object of the present invention to provide an improved ZIF connector which is simple in structure and wherein the high contact stability between contacts connected to each other is ensured.

It is another object of the present invention to provide an improved ZIF connector, wherein a high-density contact is achieved.

The present invention is applicable to a ZIF connector comprising a contact having elasticity, a fixed housing having a space for receiving therein the contact, and a movable housing having a receiving portion for receiving therein a contact portion of a counterpart connector and slidably received in the fixed housing.

According to one aspect of the present invention, the contact portion of the counterpart connector includes a bifurcate portion into which a contact portion of the contact is fittable. The contact portion of the contact extends along an attaching/detaching direction of the counterpart connector in the fixed housing. The contact has a bent portion near a bottom wall of the fixed housing. The bent portion is bent at an essentially right angle with a given curvature defined by a curvature center portion. The movable housing slidably supports the contact portion of the contact along the attaching/detaching direction and has a space for allowing deformation of the contact portion of the contact. Due to approaching of the counterpart connector for connection, the contact portion of the contact advances into the contact portion of the counterpart connector so that the contact is then pushed by the counterpart connector to move the bent portion outward relative to the curvature center portion in a direction orthogonal to the attaching/detaching direction, whereby the contact portion of the contact is deformed to abut under pressure against the contact portion of the counterpart connector at two positions.

It may be arranged that the fixed housing is provided therein with a rolling rod and that the rolling rod adheres to the bent portion at its inner side and is arranged to roll in the direction orthogonal to the attaching/detaching direction.

DESCRIPTION OF THE PREFERRED EMBODIMENT

Figure 1:
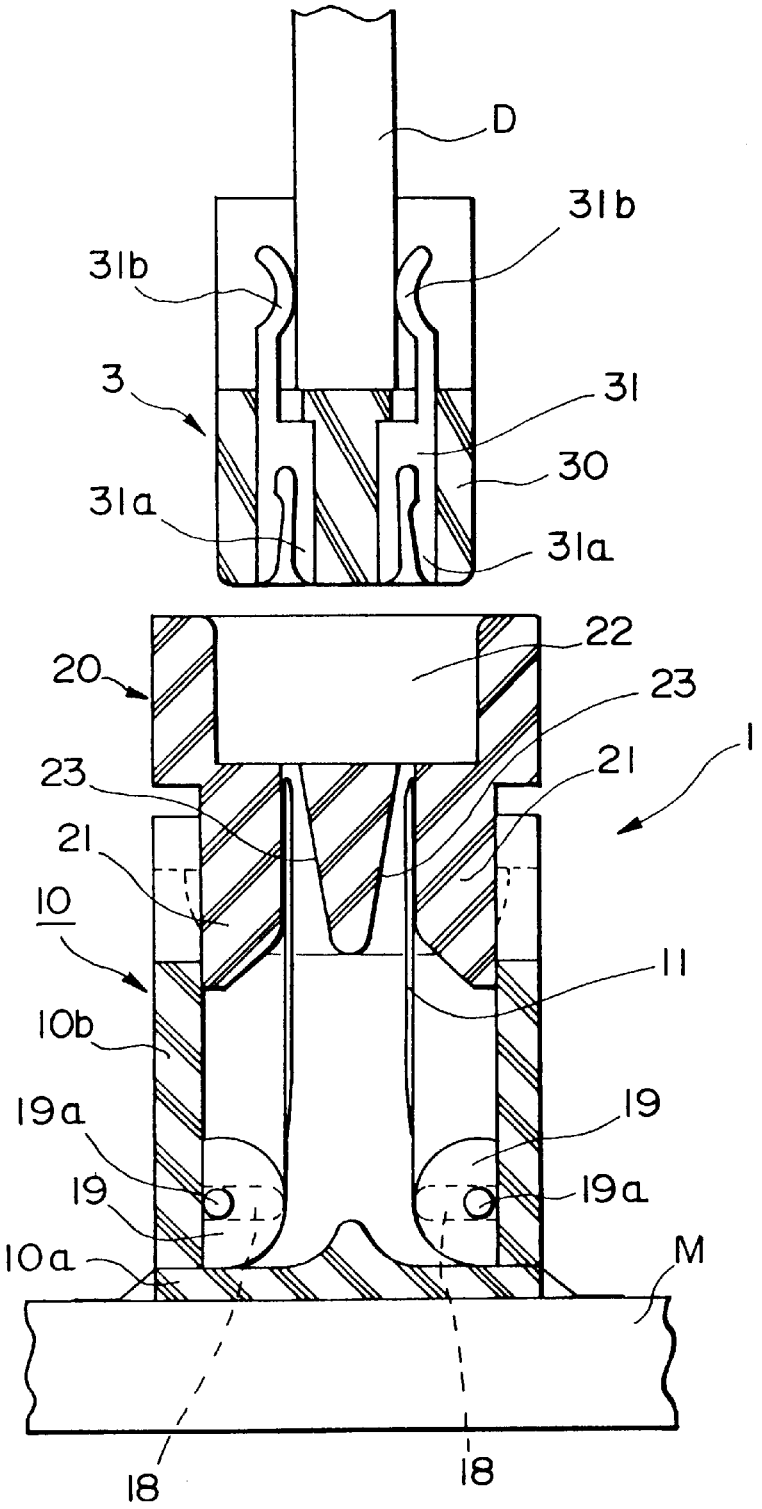
FIG. 1 is a side sectional view showing a first preferred embodiment of the present invention.
Figure 2:
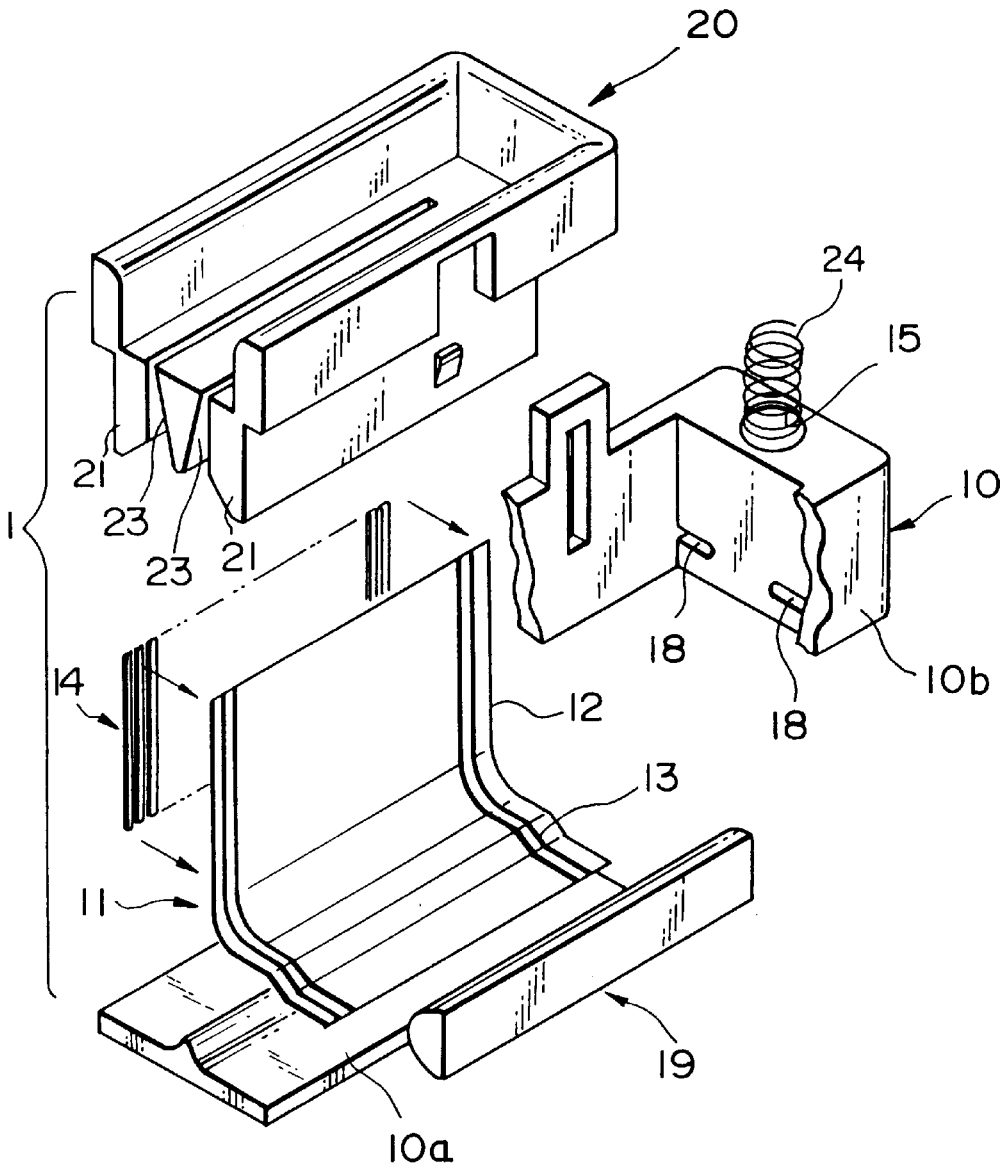
FIG. 2 is an exploded perspective view showing the main part of the first preferred embodiment of the present invention.
Figure 3:
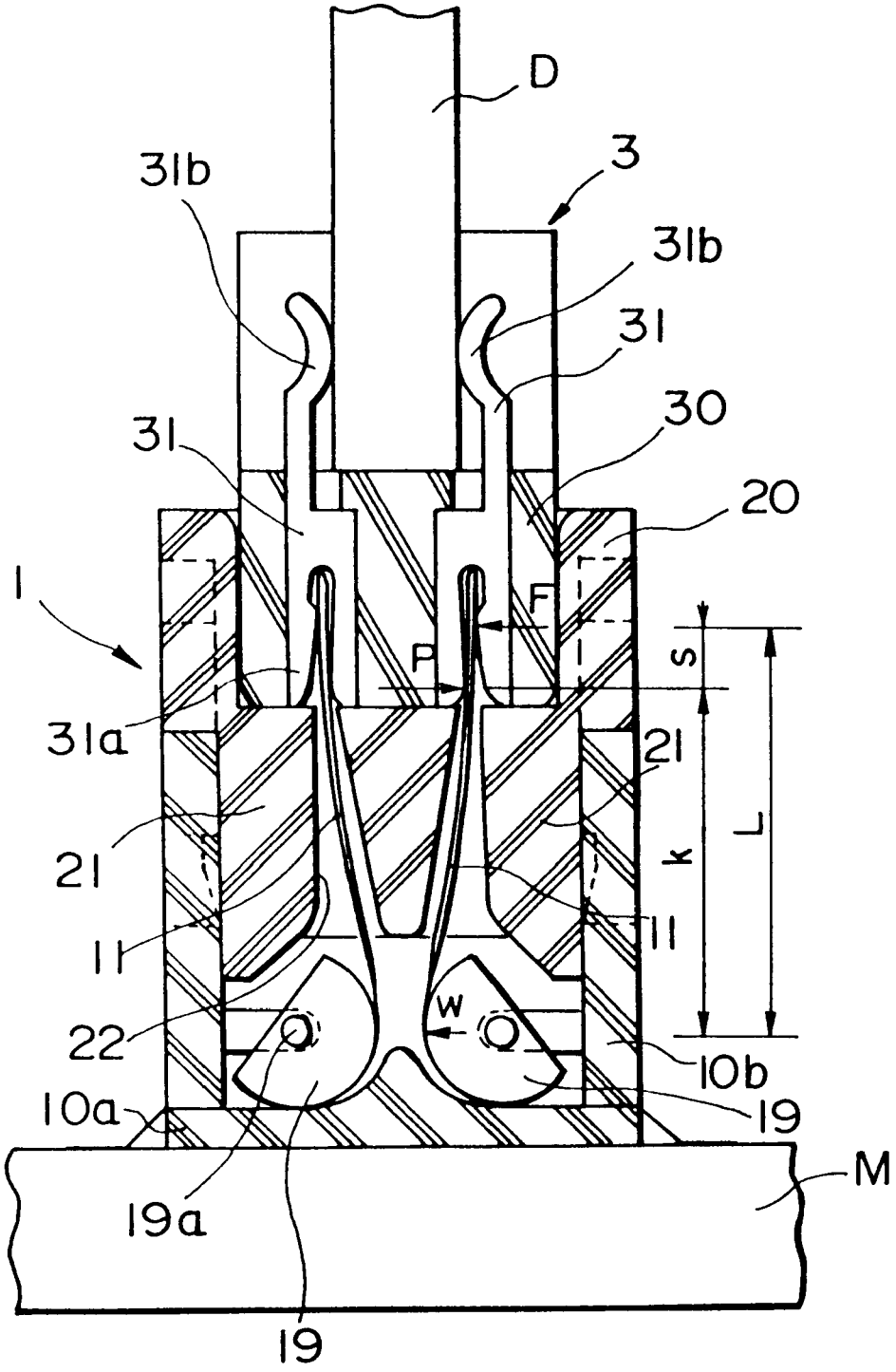
FIG. 3 is a side sectional view for explaining an operation of the first preferred embodiment of the present invention.

Referring to FIGS. 1 through 3, a ZIF connector 1 according to the first preferred embodiment of the present invention will be described hereinbelow. In this embodiment, the ZIF connector 1 is used for connecting a daughter board D to a mother board M.

In FIGS. 1 and 2, the ZIF connector 1 includes a fixed housing 10 and a movable housing 20 which is slidable in attaching (insertion) and detaching (removal) directions of a counterpart connector 3. The fixed housing 10 includes a bottom wall 10*a* fixedly held on the mother board M and extending in a direction orthogonal to the foregoing attaching or detaching direction, and a side wall portion 10*b* fixedly disposed on the edges-of the bottom wall 10*a* and extending in the foregoing attaching or detaching direction from the bottom wall lOa. The bottom wall 10*a* is formed with a protruding portion which extends along the center of the bottom wall 10*a* in its longitudinal direction. The protruding portion has opposite slant surfaces each inclining upward toward the center of the bottom wall 10*a*.

A pair of contacts 11 are disposed in the fixed housing 10. As shown in FIG. 2, each of the contacts 11 includes an insulation film 12 provided with a plurality of conductor patterns 13 attached to one side thereof and a plurality of elastic plates 14 attached to the other side as corresponding to the conductor patterns 13. The plurality of elastic plates 14 are only required when the plurality of conductor patterns 13 are formed by a member which does not have elasticity, such as a copper foil, while these are not required when the plurality of conductor patterns 13 are formed by a member having elasticity.

As shown in FIG. 1, the pair of contacts 11 are disposed in the fixed housing 10 so as to confront each other. Each contact 11 is bent outward at an essentially right angle at its lower end side. An end portion at the lower end side of the contact 11 is guided to the exterior of the fixed housing 10 through a gap between the bottom wall 10*a* and the side wall portion 10*b*. The plurality of conductor patterns 13 of the contact 11 are connected to a plurality of conductor patterns (not-shown) formed on the mother board M, respectively.

Outward of the pair of contacts 11 within the fixed housing 10, a pair of rolling rods 19 are arranged so as to be movable in directions orthogonal to the foregoing attaching or detaching direction, that is, horizontally in FIG. 1. Each of the rolling rods 19 is formed with an arc-shaped outer periphery which extends over the length of the rolling rod 19. It is so arranged that the rolling rod 19 can roll horizontally on the bottom wall 10*a* in the state where the arc-shaped outer periphery thereof adheres to the corresponding contact 11. For this purpose, each rolling rod 19 is provided with shafts 19*a* at its both axial ends. Further, two pairs of elongate guide holes 18 are formed, each extending horizontally, on the opposite inner walls of the side wall portion 10*b* for receiving therein the shafts 19*a* of the corresponding rolling rods 19 so as to allow the rolling rods 19 to move horizontally while rolling.

The movable housing 20 includes an insert portion 21 which is inserted into the space defined in the side wall portion lob of the fixed housing 10 and slidable in the foregoing attaching or detaching direction, and a receiving portion 22 provided at an upper side thereof for receiving therein a fitting portion of the counterpart connector 3.

The insert portion 21 of the movable housing 20 is formed with a pair of alignment slits 23 each extending in the foregoing attaching or detaching direction. Each slit 23 has a small width at its upper end in FIG. 1 (at its end in the foregoing attaching or detaching direction) for only allowing the corresponding contact 11 to pass therethrough, and a large width at its lower end in FIG. 1 (at its end in the foregoing attaching or detaching direction) for allowing the contact 11 to be deformed. Specifically, an outward inner wall defining the corresponding slit 23 extends along the foregoing attaching or detaching direction, while an inward inner wall defining the slit 23 inclines relative to the foregoing attaching or detaching direction toward the center as it goes downward (in the foregoing attaching direction) so that each slit 23 is tapered as it goes upward (in the foregoing detaching direction).

The movable housing 20 is biased in a direction away from the fixed housing 10 (in the foregoing detaching direction) by coil springs 24 arranged at given positions on the fixed housing 10. By pushing the movable housing 20, the insert portion 21 advances into the space in the fixed housing 10. Each coil spring 24 is disposed in a recess formed at the top of the side wall portion 10*b* of the fixed housing 10.

For forming the contact portion of the counterpart connector 3, a plurality of socket contacts 31 are mounted in an insulator 30. The plurality of socket contacts 31 are arranged so as to form two-lines which correspond to the pair of contacts 11, respectively. The socket contacts 31 correspond to the conductor patterns 13 of the contacts 11, respectively. Each socket contact 31 includes a bifurcate or two-forked fitting portion 3*a* at its lower side and a holding portion 31*b* at its upper side for holding the daughter board D in a sandwiched manner cooperatively with a confronting holding portion 31*b* of the socket contact 31 of another line.

When the movable housing 20 is not pushed, that is, when the counterpart connector 3 is not connected, the upper end of each contact 11 is located within the corresponding slit 23 as shown in FIG. 1. On the other hand, as shown in FIG. 3, when the counterpart connector 3 is inserted into the receiving portion 22 of the movable housing 20 by pushing the movable housing 20, the upper end of each contact 11 advances into the receiving portion 22 and simultaneously makes contact with the fitting portions 31*a* of the socket contacts 31 of the counterpart connector 3 with no insertion force. Then, the fitting portions 31*a* pushes each contact 11 toward the bottom wall 10*a* (in the foregoing attaching direction). Thus, the rolling rods 19 adhering to the outer sides of the contacts 11 move in directions approaching each other due to deformation of the contacts 11. As a result, the upper end portion of each contact 11 abuts under pressure against upper and lower two portions at opposite sides of the fitting portion 31*a* of each socket contact 31, so that connection between the contacts 11 and the socket contacts 31 is completed.

It is assumed that the insulation film 12 and the conductor patterns 13 attached thereto are made of soft materials so that the contact 11 has no deformation resistance. In this case, in FIG. 3, contact forces P and F acting between the upper end portion of the contact 11 and the fitting portion 31*a* of the socket contact 31 and a force W acting between the lower end portion of the contact 11 and the rolling rod 19 are given by the following equation based on the principle of the lever:

$$W=(s/k)F=(s/L)P.$$

As clear from this equation, by setting (s/k) and (s/L) to be small, sufficiently large contact forces P and F can be achieved with a small force W. The force W corresponds to a rolling resistance of the rolling rod 19. An attaching or detaching force for the counterpart connector 3 is reduced as the force W becomes smaller.

As described above, in the first preferred embodiment, the sufficiently large contact forces P and F of the contact 11 relative to the socket contact 31 can be achieved with the small force W required for rolling the rolling rod 19.

Figure 4:
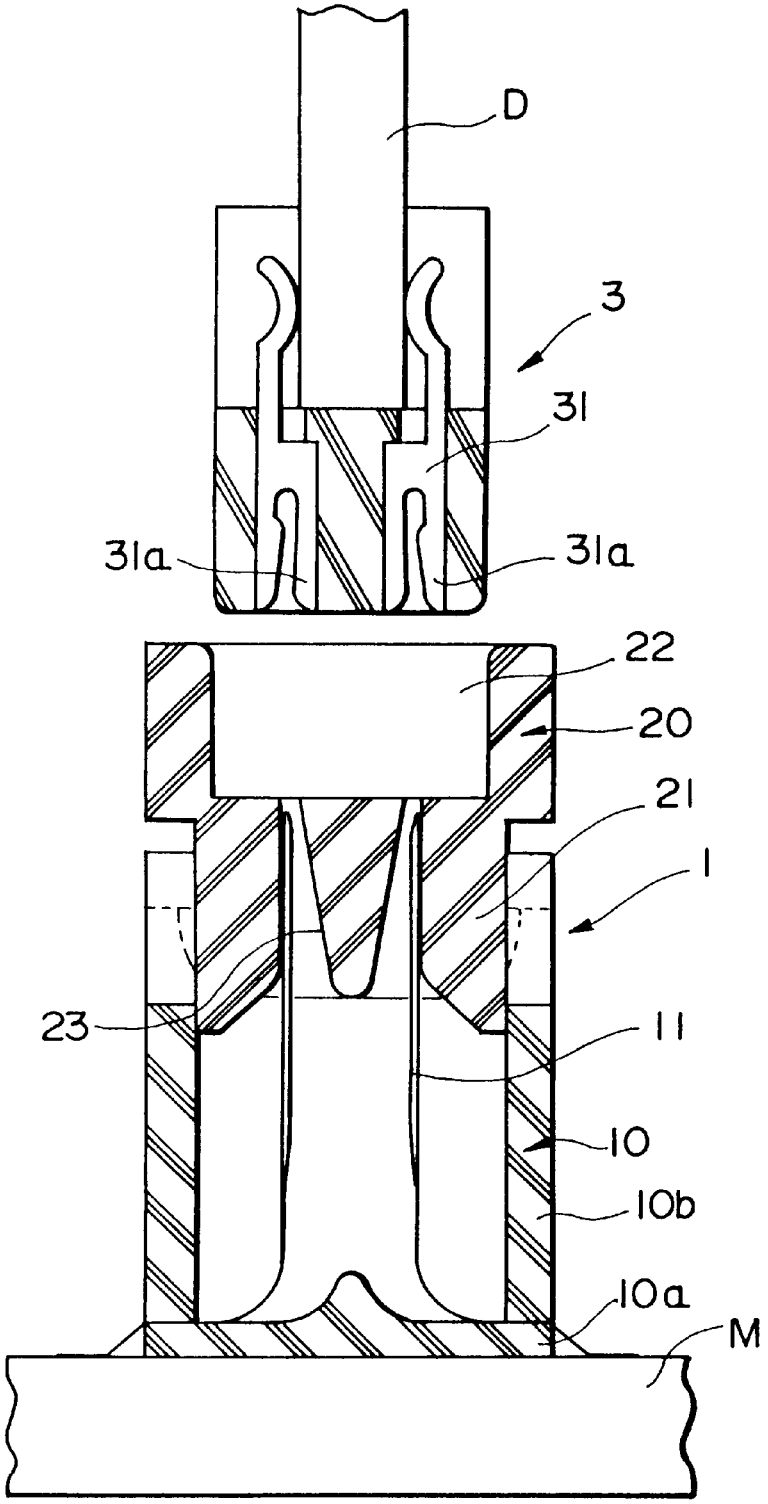
FIG. 4 is a side sectional view showing a second preferred embodiment of the present invention.
Figure 5:
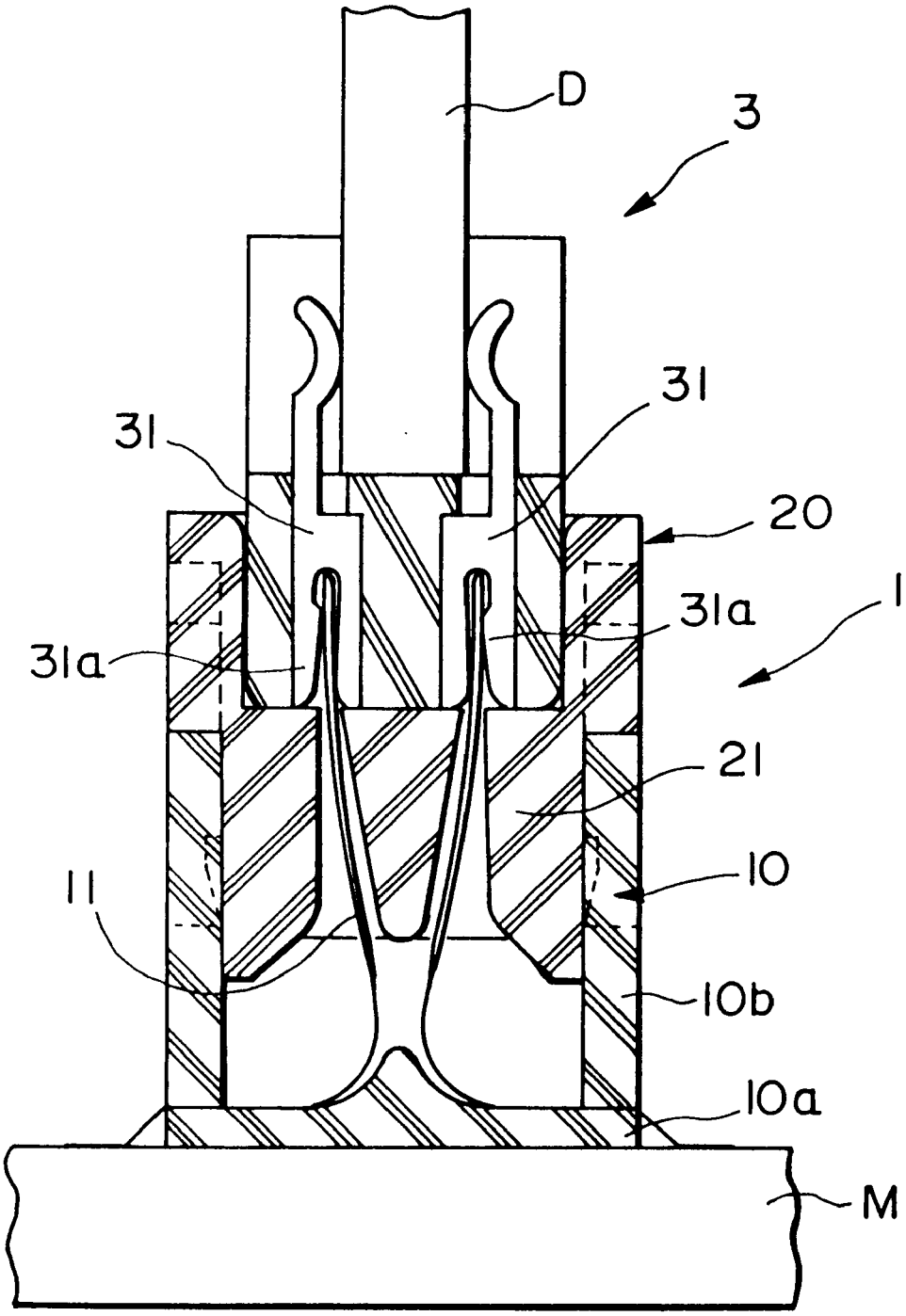
FIG. 5 is a side sectional view for explaining an operation of the second preferred embodiment of the present invention.

Referring now to FIGS. 4 and 5, a ZIF connector 1 according to the second preferred embodiment of the present invention will be described hereinbelow. The ZIF connector 1 in this embodiment differs from that in the first preferred embodiment in that the ZIF connectors 1 in this embodiment has no rolling rods 19.

In this embodiment, if each of contacts 11 is made of soft materials, since no rolling rods are provided, it may be that a bent portion of the contact 11 near a bottom wall 10*a* of a fixed housing 10 (corresponding to the bent portion of the contact 11 abutting the rolling rod 19 in the first preferred embodiment) has no constant radius of curvature. For preventing this, in this embodiment, the contact 11, particularly an insulation film 12 (see FIG. 2) or a conductor pattern 13 (see FIG. 2) is made of a material having a large flexural rigidity.

According to the second preferred embodiment, t he number of parts can be reduced owing to omission of the rolling rods to realize reduction in production cost.

Figure 6:
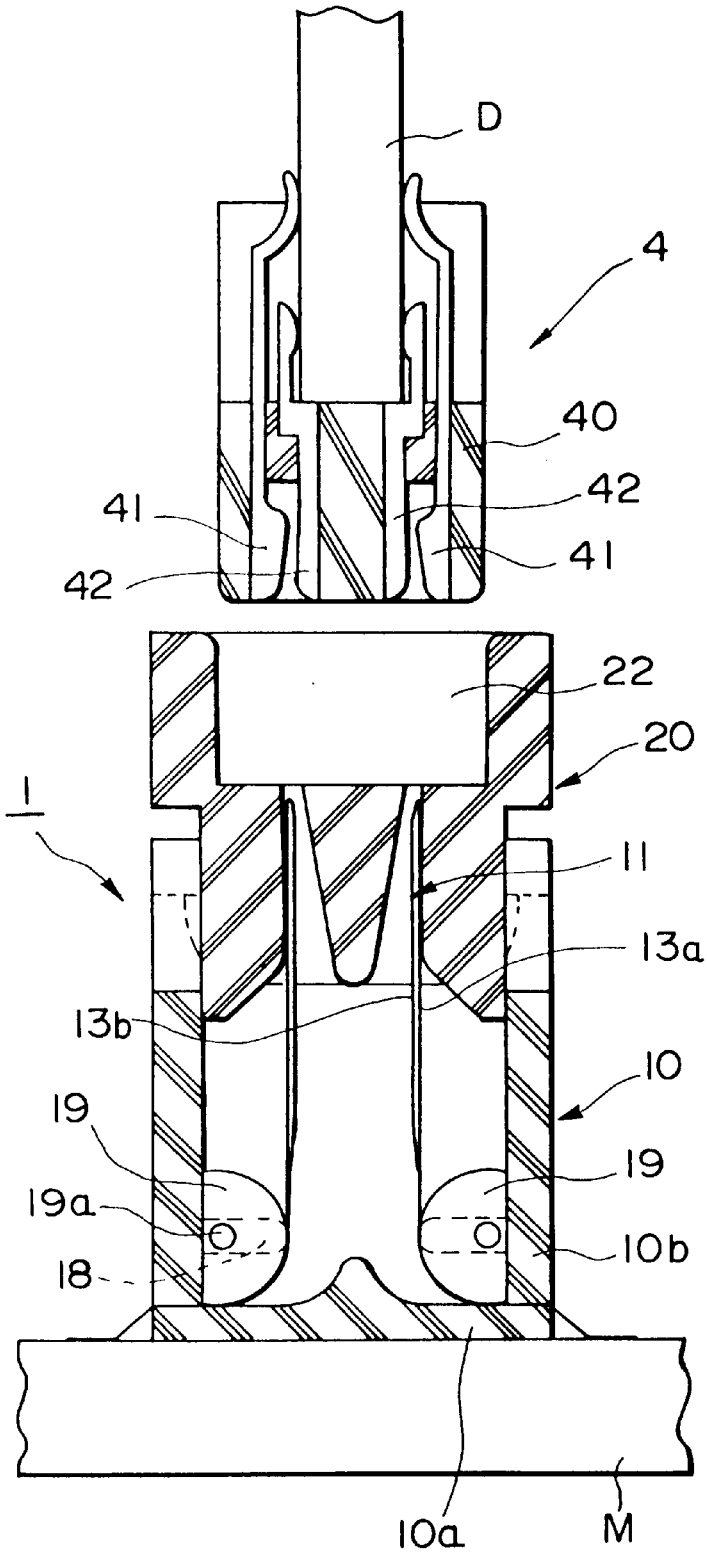
FIG. 6 is a side sectional view showing a third preferred embodiment of the present invention.
Figure 7:
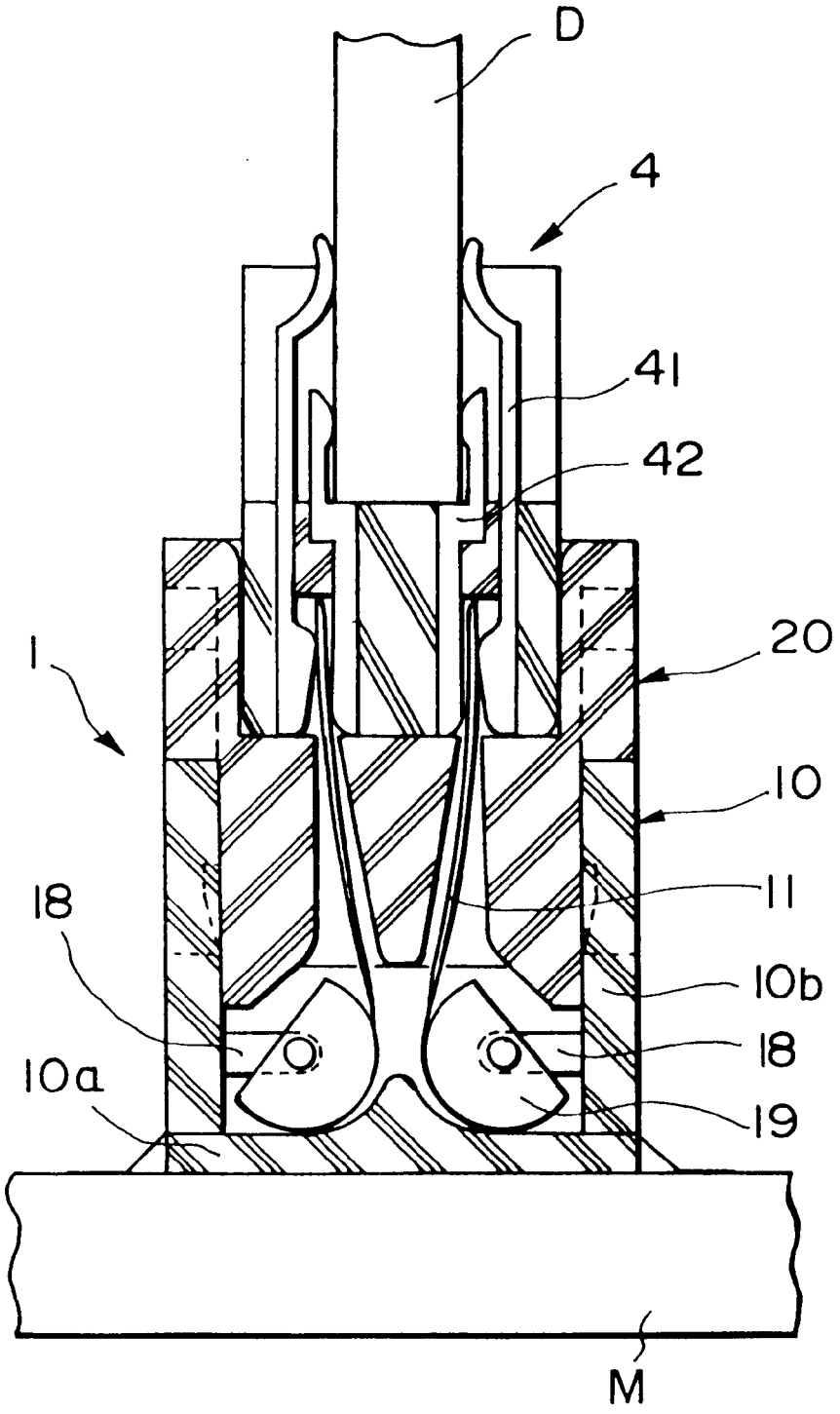
FIG. 7 is a side sectional view for explaining an operation of the third preferred embodiment of the present invention.
Figure 8:
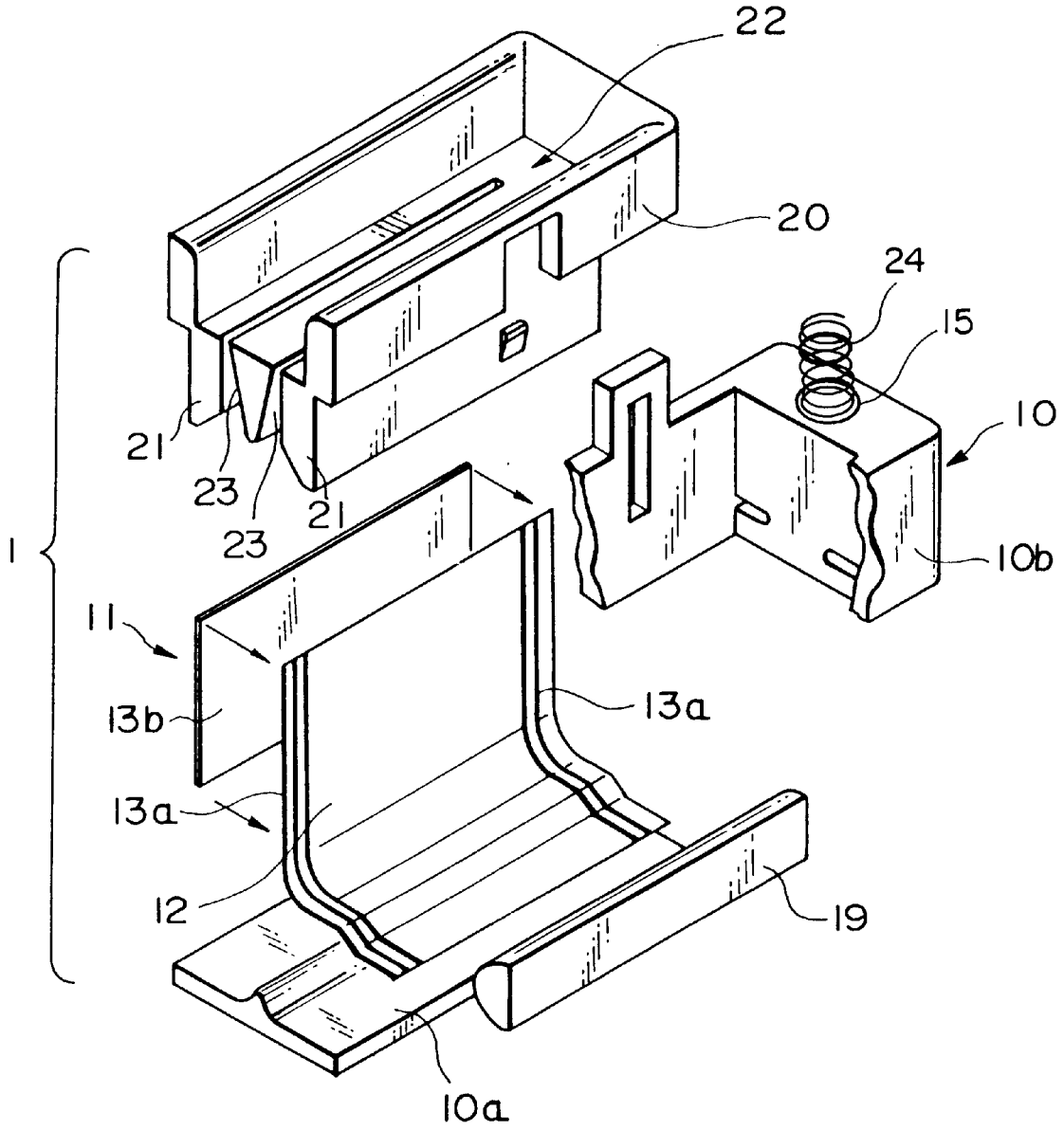
FIG. 8 is an exploded perspective view showing the main part of the third preferred embodiment of the present invention.

Referring now to FIGS. 6 through 8, a ZIF connector 1 according to the third preferred embodiment of the present invention will be described hereinbelow. This embodiment differs from the first preferred embodiment in structures of contacts 11 of the ZIF connector 1 and a counterpart connector 4.

As shown in FIG. 8, each of the contacts 11 includes an insulation film 12 provided with a plurality of conductor patterns 13*a* attached to one side thereof and one conductor pattern 13*b* attached to the other side. The conductor pattern 13*b* is in the form of a metal thin plate and works as a common ground for the plurality of conductor patterns 13*a*. In FIG. 6, a contact portion of the counterpart connector 4 includes a plurality of contacts 41 for connection to the conductor patterns 13*a* of each contact 11, respectively, and a contact 42 for connection to the conductor pattern 13*b* of each contact 11. These contacts 41 and 42 are mounted in an insulator 40.

The conductor patterns 13*a* and 13*b* may be arranged reversely as compared with the arrangement shown in FIG. 8. Further, the conductor pattern 13*b* may be used for a signal path like the conductor pattern 13*a*.

Figure 9:
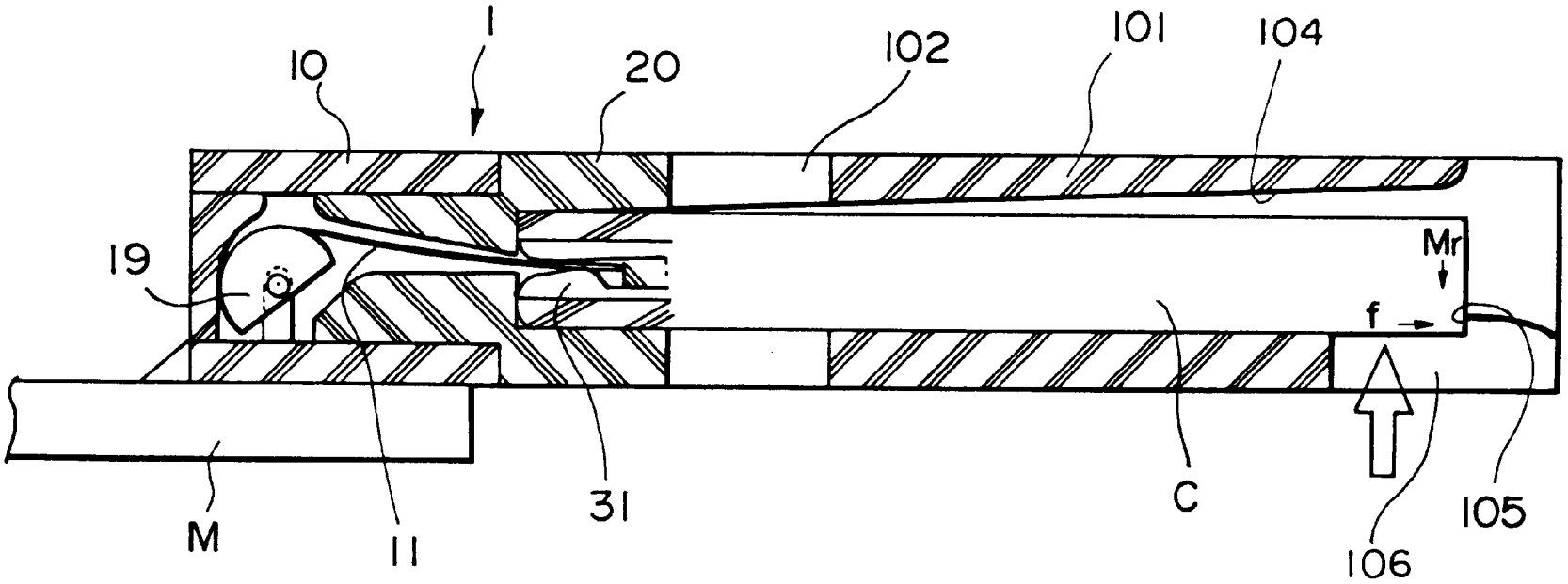
FIG. 9 is a side sectional view showing a fourth preferred embodiment of the present invention.

Referring now to FIG. 9, a ZIF connector 1 according to the fourth preferred embodiment of the present invention will be described hereinbelow. The ZIF connector 1 in this embodiment is for connection to a counterpart connector of a card-type electronic device, such as a memory card or an IC card.

The ZIF connector 1 includes a fixed housing 10 having a surrounding portion 101 integrally formed at its tip for receiving therein a card C. A movable housing 20 is slidably mounted at a cut-out portion 102 in the fixed housing 10. A lower part of the surrounding portion 101 of the fixed housing 10 is for receiving thereon the card C and formed at its tip with a stopper portion 105 in the form of a step. While connected to the ZIF connector 1, the card C engages with the stopper portion 105 so as to be prevented from coming off the fixed housing 10.

Further, an upper part of the surrounding portion 101 is formed with an inclined guide inner surface 104 so that the upper part of the surrounding portion 101 is tapered toward the tip thereof. With this arrangement, upon insertion of the card C, the card C is guided for insertion of a contact 11 of the ZIF connector 1 into socket contacts 31 of the card C. The movable housing 20 is biased in a detaching direction of the card C by coil springs like the coil springs 24 used in the first preferred embodiment . Further, the lower part of the surrounding portion 101 is formed at its tip with a window 106. in the fourth preferred embodiment, when the card C is pushed into the surrounding portion 101 along the guide surface 104, a force f is applied due to the coil springs to push back the card C. Further, an angular moment force Mr for rotating the card C is generated due to contact forces of the contact 11 relative to the socket contacts 31 (corresponding to P and F in FIG. 3). Therefore, by engaging the end of the card C with the stopper portion 105, the card C can be reliably held in a fixed state. When detaching the card C, the card C is pushed using a finger through the window 106 as shown by a blank arrow. As a result, the engagement between the card C and the stopper portion 105 is released so that the card C is pushed back by the force f and detached from the ZIF connector 1.

According to the foregoing preferred embodiments, since the ZIF connector uses the contact formed by sticking the conductor patterns to the soft insulation film, the resistance force thereof upon connection to the counterpart connector is small and thus the operation forces required upon attachment and detachment of the counterpart connector can be small. On the other hand, the sufficiently large contact forces can be achieved based on the principle of the lever between the contacts of the ZIF connector and the counterpart connector during connection therebetween.

Further, according to the foregoing preferred embodiments, since the ZIF connector uses the contact formed by sticking the conductor patterns to the insulation film, the pitch between the adjacent conductor patterns can be minimized to achieve the high-density contact. Even in case of such a high-density contact, the operation forces can be set small as described above.

Further, according to the foregoing preferred embodiments, since the ZIF connector uses the contact having sufficient flexibility, the connection between the contacts of the ZIF connector and the counterpart connector can be reliably achieved only by inserting the counterpart connector straightforward, so that the structure can be simplified.

As in the third preferred embodiment, by employing the microstrip structure where one side of the contact works as the common ground for the conductor patterns on the other side, the ZIF connector suitable for the high-speed transmission can be provided.

While the present invention has been described in terms of the preferred embodiments, the invention is not to be limited thereto, but can be embodied in various ways without departing from the principle of the invention as defined in the appended claims.

What is claimed is:

1. A ZIF connector comprising:

a contact having elasticity and having a contact portion a tone end thereof;

a fixed housing having a space for receiving therein said contact; and a movable housing having a receiving portion for receiving therein a contact fitting portion of a counterpart connector, said moveable housing being slidably attached in said fixed housing, and said movable housing being slidable in a attaching direction toward said space and a detaching direction which is away from said space;

wherein said fitting portion of said counterpart connector includes a bifurcated contact portion into which said contact portion of said contact is fittable;

wherein said contact portion of said contact is arranged in said fixed housing so as to advance into said receiving portion of said movable housing when said movable housing is pushed in the attaching direction, while said contact has a bent portion near a bottom wall of said fixed housing, said bent portion being bent at an essentially right angle with a given curvature defined by a curvature center portion, wherein said movable housing having a space for allowing deformation of said contact portion of said contact; and wherein, when said counterpart connector is inserted into said receiving portion of said movable housing and said movable housing is pushed in the inserted direction of said counterpart connector, said contact portion of said contact advances into said fitting portion of said counterpart connector so that said fitting portion of said counterpart connector pushes said contact in said attaching direction of said movable housing to move said bent portion outwardly relative to said curvature center portion in a direction orthogonal to said attaching direction, whereby said contact portion of said contact is deformed to abut under pressure against said bifurcated contact fitting portion of said counterpart connector at two positions.

2. A ZIF connector as claimed in claim 1, wherein said fixed housing is provided therein with a rolling rod, said rolling rod adhering to said bent portion and arranged to roll in the direction orthogonal to said attaching/detaching direction.

3. A ZIF connector as claimed in claim 2, wherein said bottom wall of said fixed housing is formed with an inclined surface for guiding rolling of said rolling rod.

4. A ZIF connector as claimed in claim 3, wherein said fixed housing is provided thereon with a spring for biasing said movable housing in a direction away from said fixed housing.

5. A ZIF connector as claimed in claim 1, wherein said contact comprises an insulation film and a conductor pattern attached to one side of said insulation film to form said contact portion of said contact.

6. A ZIF connector as claimed in claim 5, wherein said conductor pattern is made of a metal material having elasticity.

7. A ZIF connector as claimed in claim 1:

wherein said contact comprises an insulation film and a conductor pattern attached to one side of said insulation film to form said contact portion of said contact;

wherein said conductor pattern is made of a metal material having elasticity; and further wherein said contact comprises a conductor pattern attached to another side of said insulation film, said contact portion of said counterpart connector being a contact which is fittable to said conductor pattern attached to the one side of said insulator film and a contact which is fittable to said conductor pattern attached to other side of said insulation film.

8. A ZIF connector as claimed in claim 7, wherein said conductor pattern attached to the one side of said insulation film is a signal pattern and said conductor pattern attached to the other side of said insulation film is a ground pattern.

* * * * *